US005801490A

United States Patent [19]

Fai

[11] Patent Number: 5,801,490

[45] Date of Patent: Sep. 1, 1998

[54] FIRE-SAFE HALOGEN TORCHIERE LAMP

[75] Inventor: Chan K. Fai, Kowloon, Hong Kong

[73] Assignee: Catalina Lighting, Inc., Miami, Fla.

[21] Appl. No.: 872,416

[22] Filed: Jun. 10, 1997

[30] Foreign Application Priority Data

Oct. 29, 1996 [CN] China ..... 96 1 20428.1

[51] Int. Cl.[6] ..... H01J 7/24

[52] U.S. Cl. ..... 315/118; 315/119; 315/158; 362/248; 362/410; 362/418; 250/214 AL

[58] Field of Search ..... 315/156, 157, 315/158, 118, 119, 307, DIG. 4; 362/410, 414, 418, 421, 431, 354, 247, 243, 248, 250; 250/214 AL, 214 R

[56] References Cited

U.S. PATENT DOCUMENTS

| | | | |
|---|---|---|---|
| 4,658,129 | 4/1987 | Fan | 315/158 X |
| 4,851,645 | 7/1989 | Wolf et al. | 219/464 |
| 4,930,054 | 5/1990 | Krebs | 315/118 X |
| 5,221,141 | 6/1993 | Swanson | 362/250 |
| 5,620,247 | 4/1997 | Swanson | 362/250 |

*Primary Examiner*—Robert J. Pascal
*Assistant Examiner*—Haissa Philogene
*Attorney, Agent, or Firm*—Morey B. Wildes; Cowan, Liebowitz & Latman, P.C.

[57] ABSTRACT

A halogen torchiere lamp comprises a grid-like guard arranged across the lampshade opening for preventing flammable material from making contact with the hot glass shield of the bulb or the bulb itself. A temperature sensor is installed within the lampshade near the bulb to sense the rise in ambient temperature within the lampshade should its opening be covered by any material. The sensor comprises a thermostat that de-energizes the bulb when the sensed ambient temperature reaches a predetermined value. The sensor may also comprise a thermistor that operates the dimmer switch of the lamp to dim the bulb when the sensed ambient temperature reaches a predetermined value. The sensor may further comprise a photocell-powered thermistor that varies the bias of a transistor, which in turn causes the bulb to dim, thereby lowering the ambient temperature within the lampshade.

27 Claims, 5 Drawing Sheets

FIRE-SAFE HALOGEN TORCHIERE LAMP

BACKGROUND OF THE INVENTION

This invention relates to the field of halogen torchiere lamps and, more particularly, to safety measures for halogen torchiere lamps having horizontally installed bulbs.

A typical halogen torchiere lamp has an upward-facing lampshade mounted atop a long, upright stem. Most halogen torchiere lamps for home use have a double-ended, horizontally-mounted halogen bulb set within the lampshade. Typically, as shown in FIG. 1, a partly cross-sectional view of the head of a traditional halogen torchiere lamp, a horizontal halogen bulb 4 is mounted on two lampholders 3, which are installed on two tabs of a U-shaped bracket 2. The bracket 2 is, in turn, mounted on the threaded screw brushing 7 of the stem about its central hole. Two mounting tabs of U-shaped bracket 2 are used to install lampholder 3/reflector 26 assembly beneath bulb 4. The double-ended halogen bulb 4 is installed in the lampholders 3 above reflector 26. A half cylindrical glass shield 6 is held in position above the bulb 4 by means of two clips 17,18 to prevent contact by the user with the bulb 4 and to guard against the scattering of particles of bulb 4, should it shatter. Under reflector 26, there are lead wires, terminal blocks or wire connectors (not shown).

Most halogen torchiere lamps for home use utilize a 300 watt halogen bulb mounted within the lampshade. Naturally, the 300 watt halogen bulb generates intense heat, and generally has a working temperature of 500°–600° C. The upwardly-directed heat is further intensified by the upward reflection of the bulb's heat and luminescence by the top surface of reflector 26 and by the inside of lampshade 10. The half-cylindrical glass bulb shield 6, while intended to protect the bulb 4, unfortunately impedes air circulation and thereby contributes to the heat surrounding the bulb 4. These factors all contribute to a serious problem during indoor use where halogen torchiere lamps are often placed near draperies, curtains or other window treatments. These window treatments or other materials such as clothing, paper or toys, all of which are often made from flammable materials, could cover the upwardly-facing lampshade opening or could otherwise contact or come close enough to shield 6, which is almost as hot as the bulb 4 itself and has a working temperature of 400°–500° C., such that such materials would then be caused to ignite from the intense heat of the shield 6 and of its immediately surrounding area. Unfortunately, there have been many instances in which this has in fact occurred, causing severe burns, loss of life and extensive property damage.

There have been many attempts to solve this problem by guarding the shield 6 against contact with flammable materials. Most of such attempts have concentrated on providing some sort of protective covering for the torchiere lampshade, such as by providing a transparent or wire mesh guard over the lampshade. In one of such designs, for example, a convex wire assembly is positioned on the opening of the shade (as shown in FIG. 2) to form a grid 13. These prior art designs intend to use the grid 13 to keep the flammable material a considerable distance from the hot glass shield 6. The purpose for such a arrangement is to meet a forthcoming Underwriters Laboratories' (UL) standard, according to which two layers of cheese-cloth must not ignite after having been draped over the lampshade opening for seven hours.

Although the prior art constructions mentioned above can pass the UL safety test, there are still several shortcomings.

One of these shortcomings is that these designs often resulted in unsightly shadows being cast on the ceiling above the torchiere lamp because of the light shining through the net or grid 13. A second shortcoming is that, even if these shields were to be configured in a convex fashion so as to be further away from the bulb, the profile of the halogen torchiere lamp is thereby degraded and made less appealing by an unsightly and protrusive domed grid or convex wire net.

The most important shortcoming of these designs from a safety standpoint is the fact that a fire could still occur on a halogen torchiere lamp that was tested and approved according to the UL safety test if any material that accidentally covers the lamp is thicker, denser or allows less air infiltration than the two layers of cheese-cloth used in the UL safety test. This is due to the fact that the heat produced by the halogen bulb cannot be quickly dissipated by the lampshade surface 10 and the cover 13, and the temperature gradient from bulb 4 to cover 13, to shade 10, and to reflector 26 will be gradual. In normal condition, the temperature of the reflector will exceed 100° C. In covered condition, however, the temperature of the reflector exceeds 200° C. Therefore, the insulation of the wiring system (including the lead wire, the terminal block, the wire connector and the sleeving) in the area surrounding the reflector 26 and U-shaped bracket 2 and touching same will be degraded such that a fire caused by a short-circuit will take place. In addition, if the material that covers the lamp is flammable, i.e., it has a temperature limit of 200° C., it will become charred and will then ignite due to the intense heat above the bulb.

It is desirable, therefore, to avoid conflagrations caused by contact or proximity of flammable material to a halogen torchiere lamp shield, but without degrading either the appearance of the lamp or the light cast by the lamp.

It is also desirable to guard a halogen torchiere lamp against causing fires through contact with nearby material or through being covered thereby by providing an additional safety measure to prevent excessive temperatures in the vicinity of the halogen bulb.

It is further desirable to provide an apparatus for turning the halogen torchiere lamp off when the temperature inside the lampshade reaches a point at which fires could be caused by the high-temperature region about the bulb.

SUMMARY OF THE INVENTION

According to the invention, a flat grid formed by plurality of parallel wires with a circular border is installed flush with or slightly below the opening of the shade in order to prevent flammable materials from contacting the glass shield. A temperature sensor is installed within the lampshade on the reflector, near the midpoint of the bulb. When the lampshade opening is covered by any material, the upper portion of the lampshade acts as a greenhouse, i.e., the ambient temperature of the upper portion rises gradually. The temperature sensor located in the path of hot air flow passes the temperature sensed to a connected shut-off circuit. When the ambient temperature inside the covered lampshade exceeds a particular preset threshold value, the power circuit of the lamp is automatically triggered to shut the lamp off before the high temperature causes a fire.

Another embodiment of the invention utilizes the dimmer circuit that is already present in many halogen torchiere lamps. A control circuit with a thermistor circuit is coupled to the dimmer circuit within the prior art circuitry inside the halogen lamp for automatically adjusting the output power. When the ambient temperature sensed by the sensor exceeds the particular preset threshold value, the power of the lamp will be reduced, rather than shut off, so that the bulb shines less brightly and thereby emits less heat. The ambient temperature within the lamp is thereby maintained at a safe level, and the lamp continues to provide light for the user. As described above, this invention avoids fires being caused by the lampshade opening being unintentionally covered by any kind of material.

Accordingly, it is one object of this invention is to provide a safety construction for traditional halogen torchiere lamps to prevent a fire that could occur when the lampshade is covered by any material.

It is another object of this invention to avoid fires caused by contact or proximity of fabrics to shield 6 of a halogen torchiere lamp without degrading either the appearance of the lamp or the light cast by the lamp.

It is a further object of this invention to guard a halogen torchiere lamp against causing fires through contact with or through being covered by nearby materials by providing an additional safety measure to prevent excessive temperatures in the vicinity of the halogen bulb.

It is yet another object of this invention to provide an apparatus for turning the halogen torchiere lamp off or for lowering the intensity of the lamp when the temperature about the bulb of the lamp reaches a point at which fires could be caused by the high-temperature region about the bulb.

BRIEF DESCRIPTION OF THE DRAWINGS

The above and other objects of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
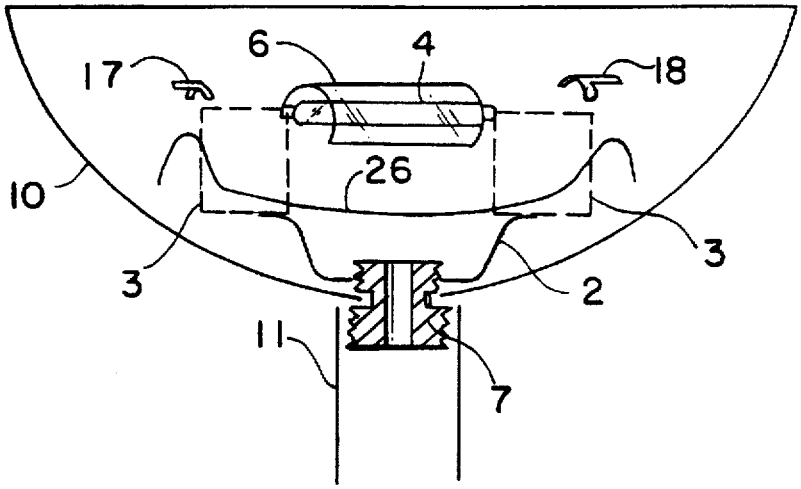
FIG. 1 PRIOR ART
FIG. 1 is a partial cross-sectional view of the head of a traditional halogen torchiere lamp head.
Figure 2:
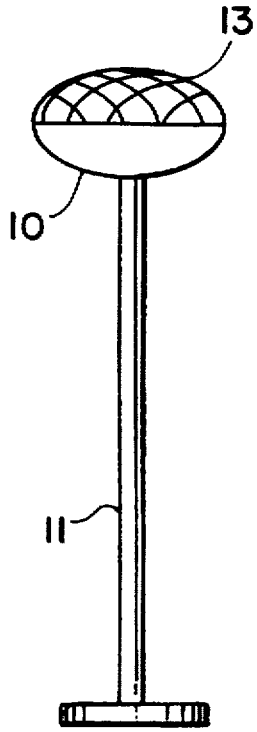
FIG. 2 PRIOR ART
FIG. 2 is a side elevational view of a traditional halogen torchiere lampshade equipped with prior art lampshade guard.

Referring to FIGS. 1 and 2, a prior art halogen torchiere lamp typically has a double-ended, horizontally-mounted bulb 4 set within the lampshade 10. Horizontal halogen bulb 4 is supported within lampshade 10 by two lampholders 3, having appropriate lead wires (not shown) and is mounted on a U-shaped bracket 2. Bracket 2 is installed on the threaded screw brushing 7 of stem 11 about its central hole. Instead of a traditional flat reflector 26, an optional prior art reflector assembly (not shown), which has the shape of a wide, low-profile rectangular or trapezoidal raised section for reflecting light from bulb 4 upward and out of lampshade 10, may be mounted beneath bulb 4. The double-ended halogen bulb 4 is installed in the lampholders 3 above the reflector assembly 26. A half cylindrical glass shield 6 is held in position above bulb 4 by means of two clips 17,18 that attach to lampholders 3 in order to prevent contact by the user with bulb 12 and to guard against scattered particles of bulb 4, should it shatter.

In addition, prior art halogen torchiere lamps often also include a wire or mesh grid, referred to as guard 13, as shown in FIG. 2, that forms a dome-like convex projection above lampshade 10. When a flammable fabric falls over lampshade 10, grid 13 provides a large air space "buffer zone" above bulb 4 in order to prevent fires from being caused by the flammable material being in too close proximity to heated bulb 4. As discussed, the profile of the torchiere lamp is thereby degraded. However, a fire may be caused even in the event that the air space provided by guard 13 is sufficient to enable the halogen torchiere lamp to pass the above-discussed UL safety test; this may occur if the flammable fabric that is unintentionally placed over lampshade 10 is thicker, denser or allows less air filtration than the two layers of cheese-cloth used in the UL safety test. This is due to the fact that the ambient temperature within the limited air space inside lampshade 10 between bulb 4 and grid 13, which is being continuously heated by bulb 4, may eventually rise to the temperature at which the flammable material combusts.

Figure 3:
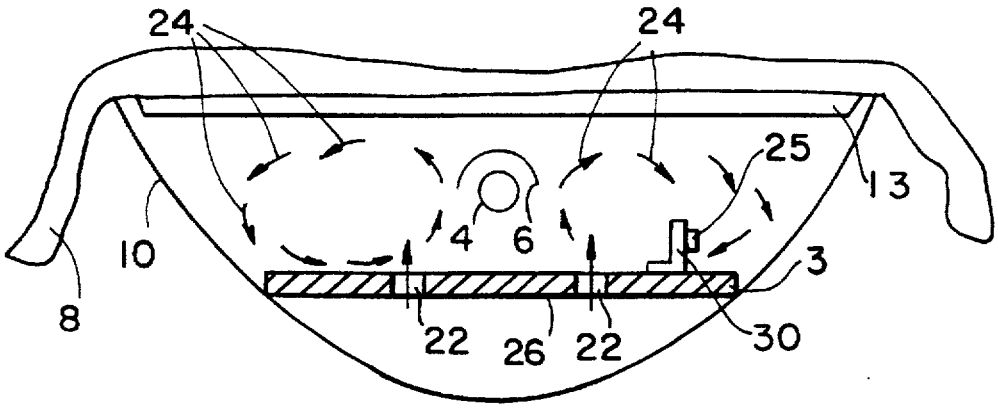
FIG. 3 is a cross-sectional view of a halogen torchiere lampshade equipped with the invention, showing the convective current air flow when the lampshade opening is covered by any material.
Figure 4:
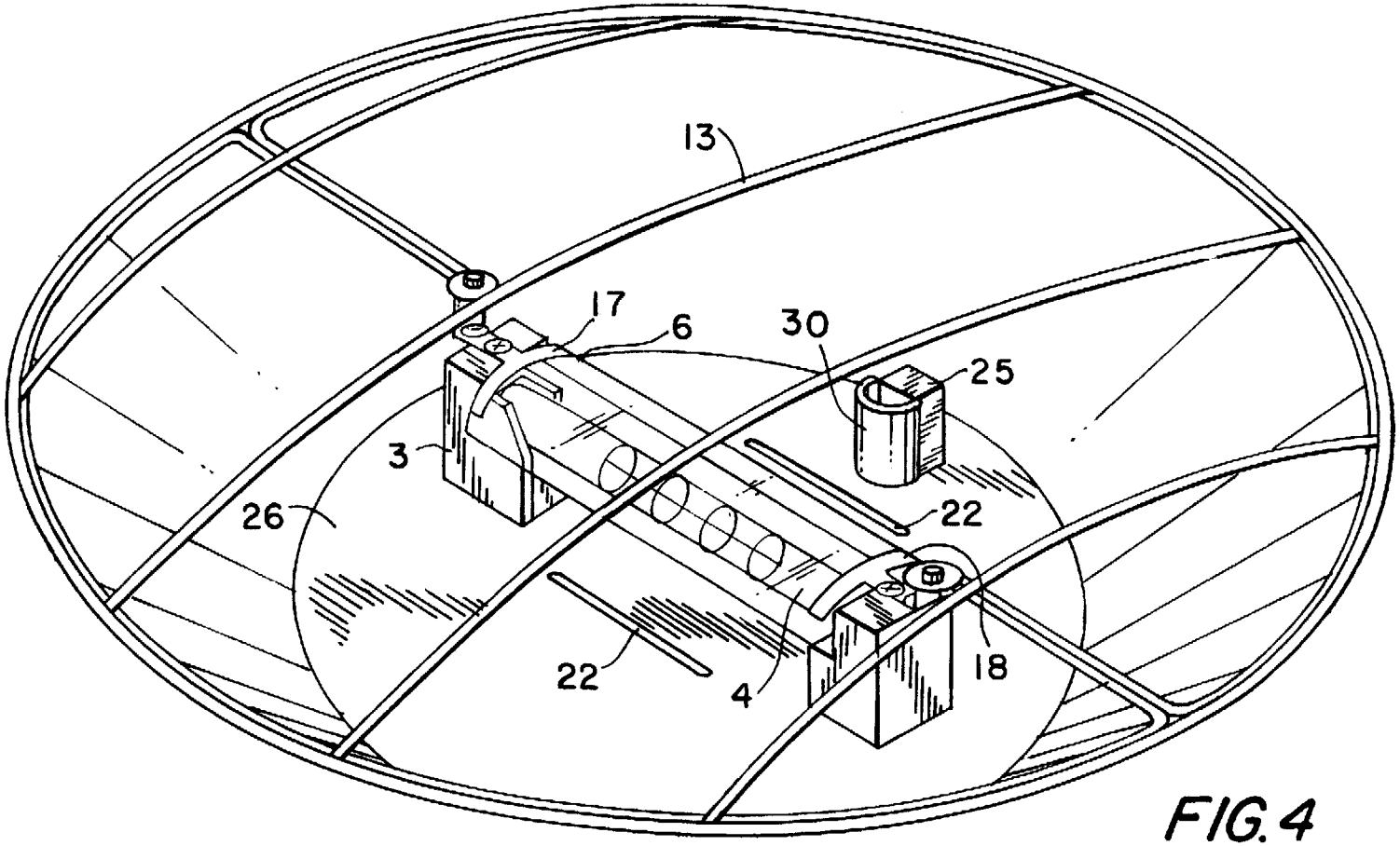
FIG. 4 is a top perspective view of a first embodiment of this invention, showing the location of each component.

An embodiment of the invention is shown in FIGS. 3 and 4. In FIG. 3, the lampshade opening is shown covered by any material 8, such as a window treatment, clothing or a flammable object such as a toy, which rests on grid 13. Bulb 4 heats its surrounding air and produces the convection air current shown by the arrows 24. A slot 22 is cut through reflector 26 on each side of bulb 4 in order to assist in forming the convective current loop. The shapes and the dimensions of slots 22 can be determined by hydrokinetics. One slot is located between bulb 4 and sensor 25, as shown in FIG. 4, and the other slot is located on the other side of bulb 4, opposite sensor 25.

Figure 3A:
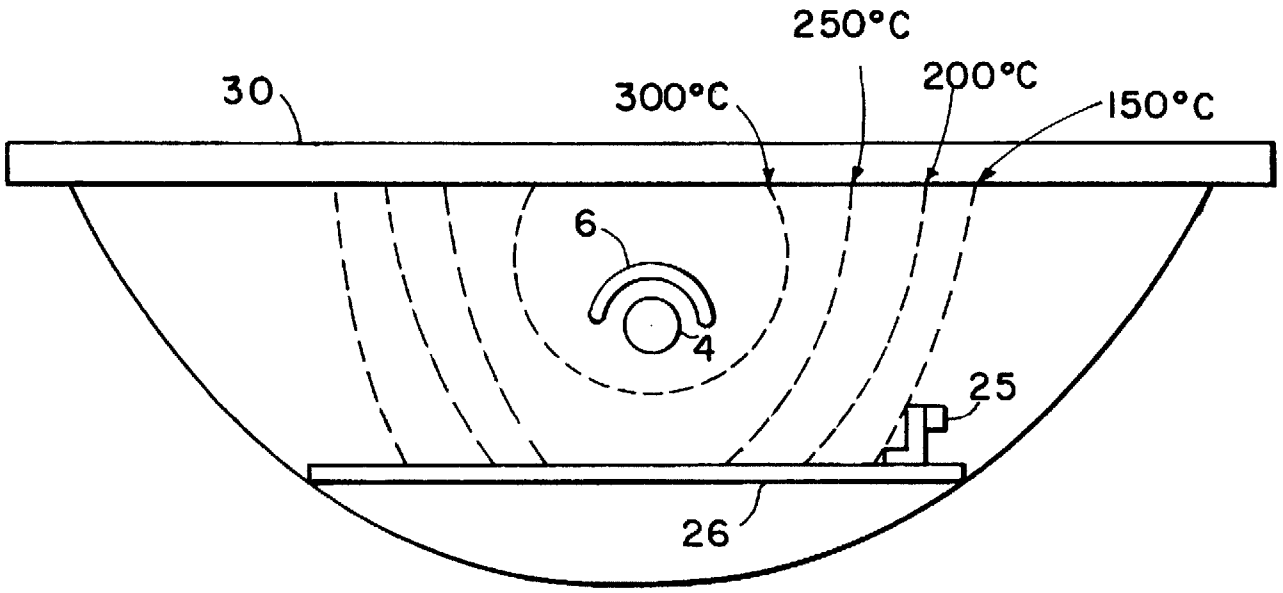
FIG. 3*a* is a cross-sectional view of a halogen torchiere lampshade equipped with the invention, showing the temperature gradient when the lampshade opening is covered by a wooden plate.

If no slot 22 is made in reflector 26, when the shade opening is covered by a wooden plate 30, as shown in FIG. 3*a*, the air convection inside the limited space formed by said plate, reflector 26 and shade 10 will stop quickly. Once the air convection stops, the temperature gradient chart will be as shown in FIG. 3*a*. The wooden plate (just above bulb 4) has the highest temperature (600° C.), and reflector 26 at the location just below bulb 4 also has a rather high temperature (at least 250° C.). Sensor 25 will reach a temperature beyond its action point (150° C.) and, as will be discussed below, will restrict the bulb output. However, the components of the wiring system above/beneath reflector 26/U-shaped bracket 2, which components have safety temperature limits as follows: wire connector-150° C.; sleeved power cord-150° C.; lead wire-200° C.; terminal block-150° C.; and nylon binder-°C., may be touching reflector 26 or bracket 2, perhaps causing their temperatures to rise beyond their respective safety limits. Thus, the insulation of the wiring system will be degraded and a fire caused by short-circuit will take place.

Figure 6:
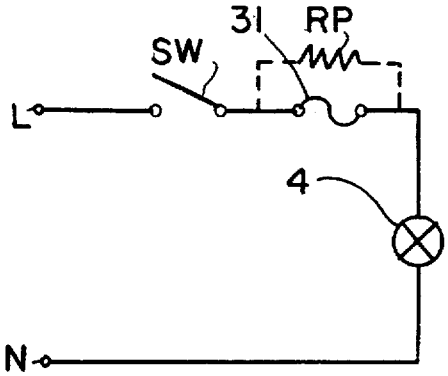
FIG. 6 is the circuit diagram of a first embodiment of this invention.
Figure 7:
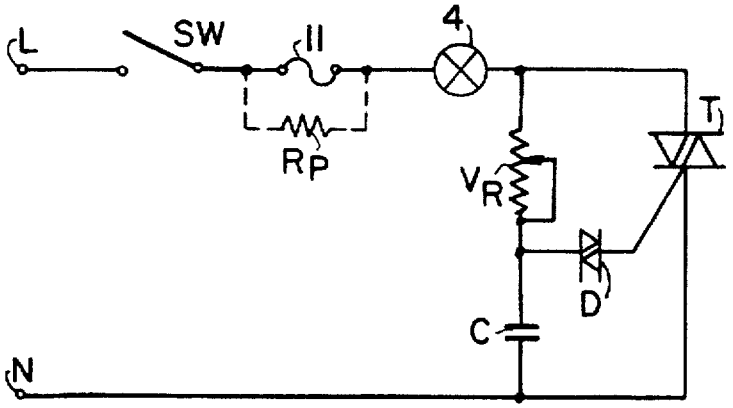
FIG. 7 is the circuit diagram of a second embodiment of this invention.
Figure 8:
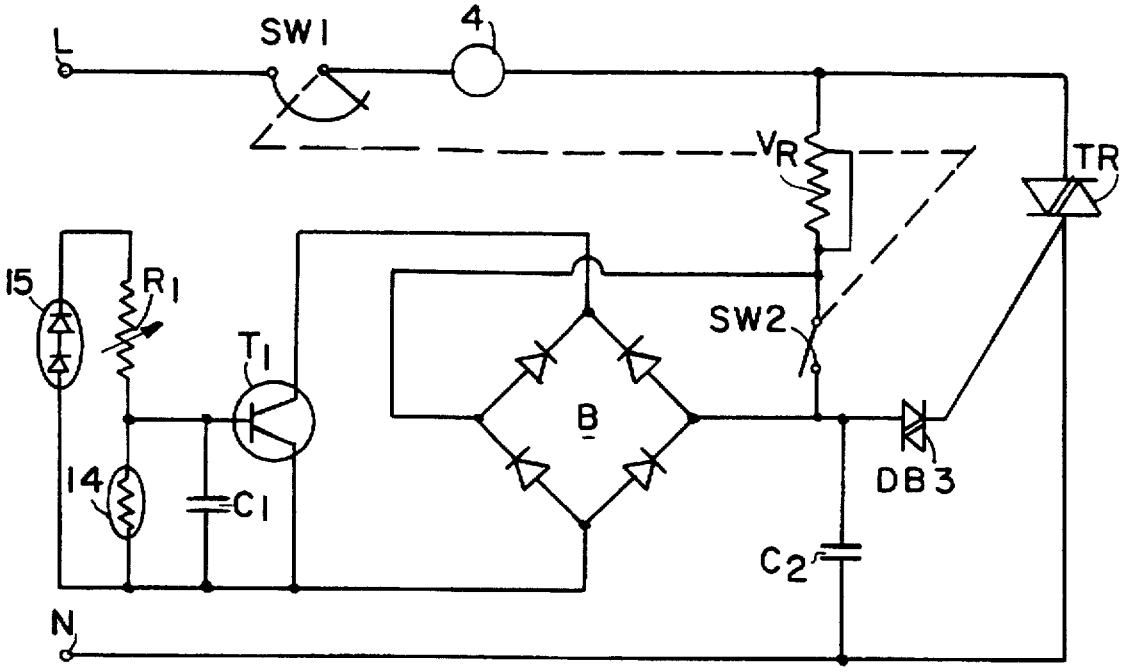
FIG. 8 is the circuit diagram of a third embodiment of this invention.

In general, the top of sensor 25 should be no higher than bulb 4 in order to prevent a shadow from being cast by sensor 25 outside lampshade 10. Sensor 25 may consist of a thermostat 31 as shown in FIG. 6. Sensor 25 may be fit into any halogen torchiere lamp using the simplest control circuit, as shown in FIGS. 6 and 7. Sensor 25 may also consist of a thermistor 34, which has a more complicated control circuit diagram, as shown in FIG. 8. The internal lampshade arrangement in each embodiment has the same configuration as shown in FIG. 3 except for the electrical function of sensor 25.

FIG. 4 shows lampshade guard 13 having a circular shape. However, any border shape of guard 13 can be used, such as rectangular, square, elliptical, etc. Lampshade guard 13 should be formed of wires that extend across the top of the lampshade in such a way as not to cast shadows. Several parallel wires extend across the lampshade in a direction that is not co-planar with, but is preferably perpendicular to, that of halogen bulb 4 and in a convex profile. Thus, because the wires are not co-planar with the bulb, shadows are not cast.

Figure 5:
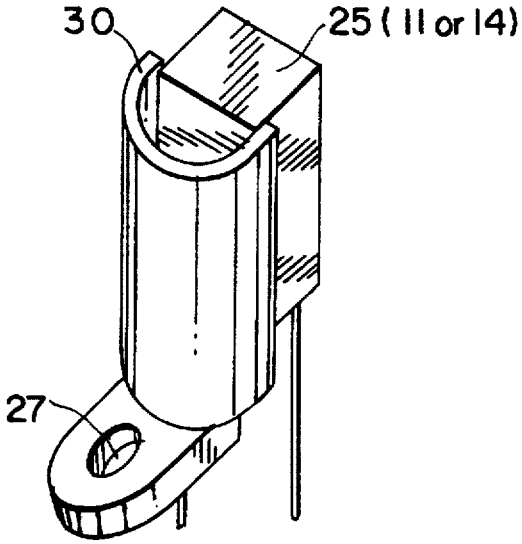
FIG. 5 is a top perspective view of the sensor used in FIG. 4, showing the thermostat and the mask.

In the first embodiment of this invention, sensor 25 comprises a thermostat 31, as shown in the controlling circuit diagram of FIG. 6. Thermostat 31 is used because automatically resetting thermostats are common and are widely used in primary circuits for automatically breaking/connecting the circuit based on ambient temperature. If thermostat 31 is chosen with its current rating, say 1 A, 2 A, etc., thermostat 31 can replace the original fuse used in the lamp. FIG. 5 shows that the sensor 25 of this invention consists of two main parts, the first of which is the automatically-resetting thermostat 31 and the second of which is a half-cylindrical mask 30. It is preferred that mask 30 extend slightly higher in height than thermostat 31 in order to prevent direct illumination of the thermostat body 31 by bulb 4, as this would cause thermostat 31 to read an artificially high temperature. The air buffer space formed between mask 30 and thermostat 31 is intended to allow for air flow to prevent the temperature sensed by thermostat 31 from being affected by the proximity to mask 30, which is illuminated directly by bulb 4.

Mask 30 is preferably formed of an aluminum sheet, the thickness of which has no limit but in normal use is preferably 0.4 to 0.7 mm. Mask 30 can be attached to thermostat 31 by first being clipped to the thermostat 31 and then being glued to it by epoxy resin. Mask 30 can then be fixed on reflector 26 by its extended portion, which has an eyelet 27 through which a rivet is passed to form a mechanical attachment. Other means of attachment can also be used. Insulating sleeves should be used on the leads of thermostat 31 according to safety requirements. For a halogen torchiere lamp with a 300 watt bulb and a lampshade opening diameter of twelve inches, a 130° C. rating thermostat 31 is used.

Thus, when the lamp is turned ON and any material covers the lampshade opening, thermostat 31 will disconnect the electrical power to the bulb before the covering material reaches 250° C. and ignites. In this case, the temperature of the central wire grid is set to reach approximate maximum temperatures of 150° C. uncovered and 250° C. covered, respectively. In normal use, when the halogen torchiere lamp is turned ON at its full output wattage (generally 300 watts), if the shade opening is covered by any material, thermostat 31 will automatically cut off power to bulb 4 within approximately twenty seconds, as the maximum allowed temperature is quickly achieved. Then, after approximately twenty minutes, the cooled halogen torchiere lamp will turn back ON. Since the life expectancy of the thermostat is approximately 10,000 ON/OFF cycles, the lifetime of this inventive device is acceptable.

FIG. 7 shows the circuit diagram of the second embodiment of this invention. In this case, the halogen torchiere lamp is equipped with an electronic dimmer, and thermostat 31 can be put in series with said dimmer so that the dimmer will automatically adjust the output power. When the dimmer is adjusted to the full ON position, the output of the halogen lamp is 300 watts. The resulting ON/OFF cycle will be the same as that discussed above with respect to the first embodiment. When the dimmer is adjusted to any position other than the full ON position, the lamp's output will be less than 300 watts and the result will be safer than that mentioned in the first embodiment. In this lower power output position, for example, 150 watts, thermostat 31 will not act to shut the power off since the ambient temperature within lampshade 10 does not exceed the action point of the thermostat 31. Thus, because the ambient temperature within lampshade 10 does not get too high, the flammable material will not combust.

However, over an extended period of time during which lampshade 10 is covered, the ambient temperature within lampshade 10 sensed by thermostat 31 will rise and exceed the preset threshold value. In this instance, the dimmer will automatically lower the bulb output. Thus, the brightness of bulb 4 and the heat emitted is reduced, while the ambient temperature within lampshade 10 is maintained at a safe level. During the time that the bulb output is reduced, bulb 4 is allowed to cool somewhat while still providing light to the user.

In the two embodiments described above, in order to prevent thermostat 31 from having an endless ON/OFF cycle caused by the covered lampshade opening, a resistor Rp packed by 0.2 mm thick insulation taper and 2K Ohm/5 Watt can be connected in parallel to thermostat 31, as shown by the wiring with dotted lines in both FIGS. 6 and 7. Resistor Rp is bound to thermostat 31 by suitable means. Therefore, once thermostat 31 is OFF, electric current will pass through resistor Rp, and the heat produced by resistor Rp will keep thermostat 31 on its OFF condition until the user unplugs the lamp. After the lamp is unplugged, there will be no current in resistor Rp, and the temperature of resistor Rp as well as thermostat 31 will revert thermostat 31 to the ON position. This adds an additional safety feature for preventing fires from taking place by requiring the user to unplug and then re-plug the lamp in order for the lamp to function further. Besides this function, the user is also required to remove the covering of the lampshade opening before turning ON the lamp, otherwise this cycle will repeat.

Alternatively, this additional safety feature can be accomplished simply by using a thermostat having the property that, once it is OFF, the lamp must be unplugged in order to reset it. Thus, in this version, resistor Rp can be omitted in favor of this specific type of thermostat.

FIG. 8 shows the circuit diagram of the third embodiment of this invention. In this case, sensor 25 consists of a thermistor 34, preferably SDT1000 rating. Additionally, a photocell, preferably S740 rating, is installed in order to supply DC current to thermistor 34 so that there is sufficient bias to control the transistor, preferably MJE 13003, which in turn controls the triac, preferably Q4010L4. Installation of thermistor 34 onto mask 30 is similar to installation of thermostat 31 onto mask 30, as discussed above. Photocell 15 can be installed in a location within the lampshade which is cooler, for example, at a location farther from the bulb than the location of thermistor 34. As shown in FIG. 8, capacitor C1 is preferably rated 4.7 μF/16 V, capacitor C2 is preferably rated 0.068 μF/250 V, and rheostat R1 is rated 1K Ohm.

The difference between the third embodiment and the first and second embodiments is the electronic circuit diagram and their functions. In first and second embodiments, sensor 25 senses that the ambient temperature within lampshade 10 exceeds a predetermined value and either simply cuts off the power supply to the lamp and thereby shuts the lamp OFF or utilizes the dimmer to reduce the power output of bulb 4. But in the third embodiment (see FIG. 8), thermistor 34 senses the ambient temperature within lampshade 10 and thus varies the bias on the gate of the transistor. The resistance (R c-e) of said transistor will continuously be changed accordingly and, therefore, the charging current on the left side of the trigger diode will be controlled accordingly. This in turn controls the dimness degree-of the triac.

Photocell 15 can be arranged so that, when bulb 4 is in its half output condition, the output of photocell 15 can still make the transistor work.

Thermistor 34 can be packed with several layers of sleeves in order to increase the thermal capacity of the whole sensor 25. That is, when the ambient temperature within the lampshade reaches 130° C., the thermal gradient of the sleeve layers must be at least 10° C. Then, thermistor 34 senses a temperature of 120° C. and the transistor functions to dim bulb 4 slightly. But, since the sleeve layers still pass some thermal energy to thermistor 34, bulb 4 will be dimmed further. Even if bulb 4 is completely turned off, the sleeve layers will maintain the bulb's temperature at no less than 120° C. for at least ten minutes. This arrangement prevents the length of the period of the ON/OFF cycle of the bulb 4 from being too short, such as less than ten minutes. This arrangement can be used in all embodiments of this invention, especially if a low-rating (say, 120° C. or less) thermostat/thermistor is used. In doing so, mask 30 can be replaced by an enclosure of any suitable shape. This method is used especially when thermostat 31/thermistor 34 has a lower temperature rating, such as 120° C., instead of the original 130° C. rating.

In FIG. 8, switch SW1, switch SW2 and the potentiometer VR (preferably 500K, ½ Watt) are coaxial. When the common axis is turned clockwise, SW1 is ON first, the potentiometer is then from the low voltage to the high voltage, and SW2 is ON. Since initially bulb 4 (preferably 300 watt and 230 volt) is dim, the photocell does not have enough-output to push the transistor. Thus, the triac will not work and bulb 4 will remain dim. Therefore, SW2 must be always in its ON position in order to make the whole circuit a traditional one, since the two leads of the bridge B (4×1N4007) are short-circuited by SW2. When the common axis is turned to the mid point, for example, the half output of bulb 4, SW2 is arranged OFF since now the brightness of bulb 4 has enough energy to push whole inventive circuit to work.

Figure 9:
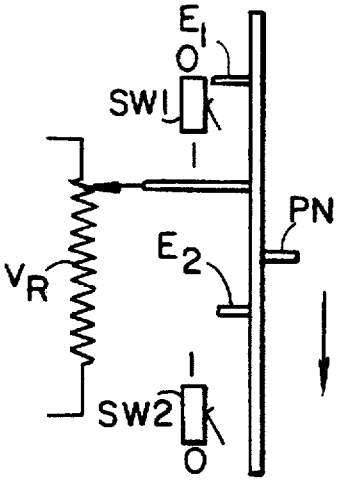
FIG. 9 is a schematic diagram of the third embodiment of the invention.

In practice, SW2 can be replaced by a separate switch such as a push-button switch, rock switch or a dip switch, etc. SW1 can also be separate from the potentiometer. In FIG. 9, rock switches SW1 and SW2 together with the potentiometer VR are all installed in the stem of the lamp. One button PN is used to control all three. When button PN is pushed downward, knob E1 pushes ON the SW1 first. When button PN continues further down and reaches its middle point, knob E2 pushes the SW2 OFF. If button PN is now pushed upward, SW2 will be pushed ON first, after which SW1 will be pushed OFF. Such an arrangement is preferred when a sliding potentiometer is used.

Thus, a fire-safe halogen torchiere lamp is provided. One skilled in the art will appreciate that the present invention can be practiced by other than the described embodiments, which are provided for purposes of illustration and not limitation, and that the present invention is limited only by the claims that follow.

What is claimed is:

1. A fire-safe halogen torchiere lamp, wherein said lamp comprises a lampshade mounted at one end of a stem and having an opening facing upward, a halogen bulb mounted within said lampshade and a shield at least partially covering said bulb, the improvements comprising:

a guard mounted across the opening of said lampshade to prevent fabrics or other flammable materials from contacting said shield or said bulb; and a temperature sensor mounted within said lampshade in close proximity to said bulb and electrically coupled thereto, wherein said sensor further comprises a shield mounted between said sensor and said bulb for preventing direct illumination of said sensor by said bulb;

whereby, when said lampshade opening is covered by a material thereby forming an enclosed air space, the ambient temperature within said enclosed air space sensed by-said sensor will rise, and, at a pre-set temperature, said sensor will cause the output of said bulb to be restricted to a safe level.

2. The fire-safe halogen lamp of claim 1, wherein said guard comprises a series of wires affixed across the opening of said lampshade.

3. The fire-safe halogen lamp of claim 1, wherein said lampshade opening is round and said guard comprises a circular wire ring having the approximate diameter of said lampshade opening and at least two substantially parallel wires extending across said circular wire ring.

4. The fire-safe halogen lamp of claim 1 wherein said temperature sensor comprises a thermostat electrically coupled to said bulb via the power circuit of said lamp, whereby, when the sensed ambient temperature within said enclosed air space within said lampshade reaches a pre-set temperature, said thermostat causes power to said bulb to be shut off.

5. The fire-safe halogen lamp of claim 4 wherein said shield has a half-cylindrical shape about said thermostat and extends slightly higher than said thermostat.

6. The fire-safe halogen lamp of claim 4 wherein said shield is spaced from said thermostat to allow air flow between said shield and said thermostat.

7. The fire-safe halogen lamp of claim 4 wherein said thermostat is set such that, once said thermostat causes power to said bulb to be shut off, said lamp must be unplugged and plugged-in again in order for power to be restored to said bulb.

8. The fire-safe halogen lamp of claim 4 wherein power is restored to said bulb once said sensed ambient temperature falls a pre-set amount below said pre-set temperature.

9. The fire-safe halogen lamp of claim, 8 wherein said thermostat is insulated to cause an increase in thermal capacity such that its off-on period is lengthened.

10. The fire-safe halogen lamp of claim 4 wherein said lamp comprises a reflector element mounted substantially horizontally beneath said bulb, wherein said reflector comprises at least one slot formed therethrough to allow air flow to said bulb.

11. The fire-safe halogen lamp of claim 10 wherein at least one of said slots is located between said temperature sensor and said bulb.

12. The fire-safe halogen lamp of claim 11 wherein another of said at least one slot is located on the side of said bulb opposite to said temperature sensor.

13. The fire-safe halogen lamp of claim 1 wherein said temperature sensor comprises a thermostat electrically coupled to said bulb via the power circuit of said lamp, whereby, when the sensed ambient temperature within said enclosed air space within said lampshade reaches a pre-set temperature, said thermostat causes current to said bulb to be shut off.

14. The fire-safe halogen lamp of claim 13 wherein said shield has a half-cylindrical shape about-said thermostat and extends slightly higher than said thermostat.

15. The fire-safe halogen lamp of, claim 13 wherein said shield is spaced from said thermostat to allow air flow between said, shield and said thermostat.

16. The fire-safe halogen lamp of claim 1 wherein said pre-set temperature of said lamp is set such that the output of said bulb is restricted to a safe level prior to the flammable materials covering said lampshade opening being caught on fire.

17. The fire-safe halogen lamp of claim 1 wherein said lamp comprises a dimmer circuit and said temperature sensor comprises a thermistor electrically coupled to said bulb via the dimmer circuit of said lamp, whereby, when the sensed ambient temperature within said enclosed air space within said lampshade reaches a pre-set temperature, said thermistor causes said bulb to be dimmed.

18. The fire-safe halogen lamp of claim 17 wherein said shield has a half-cylindrical shape about said thermistor and extends slightly higher than said thermistor.

19. The fire-safe halogen lamp of claim 17 wherein said shield is spaced from said thermistor to allow air flow between said shield and said thermistor.

20. The fire-safe halogen lamp of claim 17 wherein brightness is restored to said bulb once said sensed ambient temperature falls a pre-set amount below said pre-set temperature.

21. The fire-safe halogen lamp of claim. 20 wherein said thermostat is insulated to cause an increase in thermal capacity such that its dim-bright period is lengthened.

22. The fire-safe halogen lamp of claim 17 wherein said lamp comprises a reflector element mounted substantially horizontally beneath said bulb, wherein said reflector comprises at least one slot formed therethrough to allow air flow to said bulb.

23. The fire-safe halogen lamp of claim 22 wherein at least one of said slots is located between said temperature sensor and said bulb.

24. The fire-safe halogen lamp of claim 23 wherein another of, said at least one slot is located on the side of said bulb opposite to said temperature sensor.

25. The fire-safe halogen lamp of claim 1 wherein said sensor comprises a thermistor and further comprising a photocell mounted within said lampshade and electrically coupled to said thermistor, such that said photocell supplies DC energy to said thermistor.

26. The fire-safe halogen lamp of claim 25 wherein said photocell is arranged such that it can supply enough DC energy to said, thermistor even if said bulb is producing half its maximum power output.

27. The fire-safe halogen lamp of claim 25 wherein said power output of said bulb is reduced as the ambient temperature sensed within said enclosed airspace within-said lampshade increases.

* * * * *